United States Patent [19]

Rowekamp

[11] 4,066,163

[45] Jan. 3, 1978

[54] ROW FORMER FOR ARTICLES

[75] Inventor: Edward F. Rowekamp, Cincinnati, Ohio

[73] Assignee: The Lodge & Shipley Company, Cincinnati, Ohio

[21] Appl. No.: 624,866

[22] Filed: Oct. 23, 1975

Related U.S. Application Data

[62] Division of Ser. No. 502,039, Aug. 30, 1974, abandoned.

[51] Int. Cl.[2] ..... B65G 47/26

[52] U.S. Cl. ..... 198/442; 198/503

[58] Field of Search ..... 198/31 AC, 31 R, 85, 198/100, 31 AB, 24, 425, 436, 442, 503

[56] References Cited

U.S. PATENT DOCUMENTS

| | | | |
|---|---|---|---|
| 2,262,799 | 11/1941 | Everett | 198/24 |
| 2,612,815 | 10/1952 | Britt | 198/425 X |
| 2,633,224 | 3/1953 | Thebault | 198/31 AC |
| 3,142,389 | 7/1964 | Bolt | 198/24 UX |
| 3,193,078 | 7/1965 | Amenta et al. | 198/31 AC |

*Primary Examiner*—John J. Love
*Assistant Examiner*—Douglas D. Watts
*Attorney, Agent, or Firm*—Wood, Herron & Evans

[57] ABSTRACT

Apparatus for forming multiple rows of articles from a single incoming row of articles. The apparatus has an elongated guide adapted to swing about a pivot point adjacent the incoming single file of articles. The downstream end carries a freely rotatable wheel with circumferentially spaced lugs engageable by the articles. A brake is connected to the wheel and a counting mechanism, associated with the wheel, operates the brake and effects the shifting of the swinging guide from one downstream lane to another when a preselected number of articles is counted.

5 Claims, 8 Drawing Figures

ROW FORMER FOR ARTICLES

This is a division, of application Ser. No. 502,039, filed August 30, 1974, now abandoned.

This invention relates to a row former for articles and particularly to apparatus for receiving articles in a single lane and forming multiple lanes of articles.

It has been an objective of the invention to provide an improved apparatus for forming multiple lanes of bottles from a single file of bottles, the improved apparatus being particularly suitable for the handling of oblong bottles. The invention includes a swinging guide pivoted at its upper end adjacent the single file bottles, the downstream end being positionable adjacent any of the multiple lanes so as to direct bottles into the lane at which the guide is positioned. At the downstream end of the guide is a freely rotating wheel having lugs or pins which project into the path of the bottles so that the bottles move past the wheel in turnstile fashion. A counter and circuitry are associated with the wheel and are connected to a braking mechanism connected to the wheel. The counter and circuitry effect the operation of the brake after a predetermined number of bottles have passed. The braked wheel holds back the incoming bottles and permits the guide to be shifted to a new lane.

The several features and objectives of the invention will become more readily apparent from the following detailed description taken in conjunction with the accompanying drawings in which.

General Organization and Operation

Figures 1, 2, 3, 4, 9:
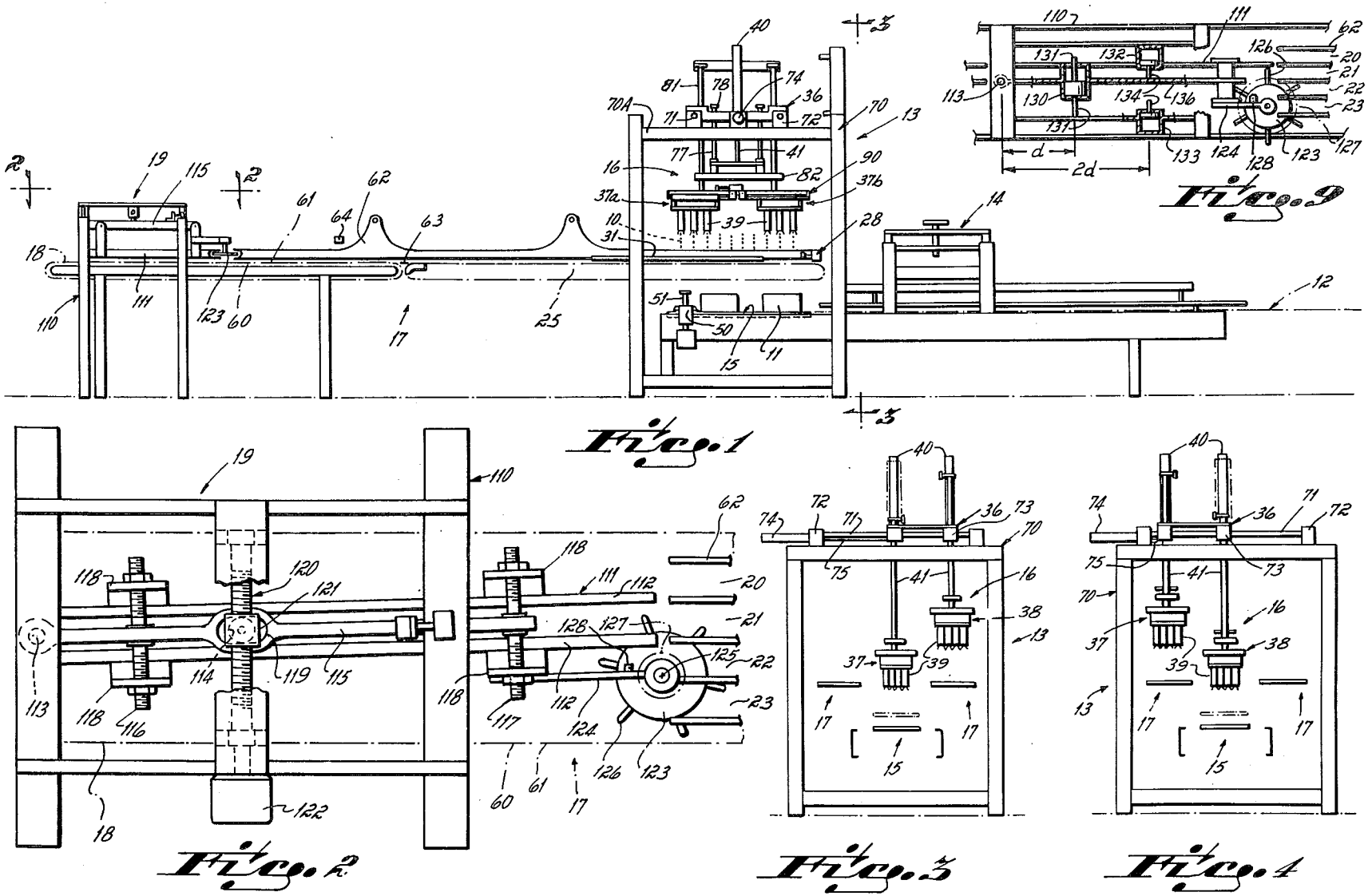
FIG. 1 is a diagrammatic side elevational view of the apparatus of the invention.
FIG. 2 is a top plan view of one embodiment of a row former, the figure being taken from lines 2—2 of FIG. 1.
FIG. 3 is a diagrammatic and elevational view of the loading station taken along lines 3—3 of FIG. 1.
FIG. 4 is a view similar to that of FIG. 3 showing the lifting heads in a different position.
Figures 5, 6:
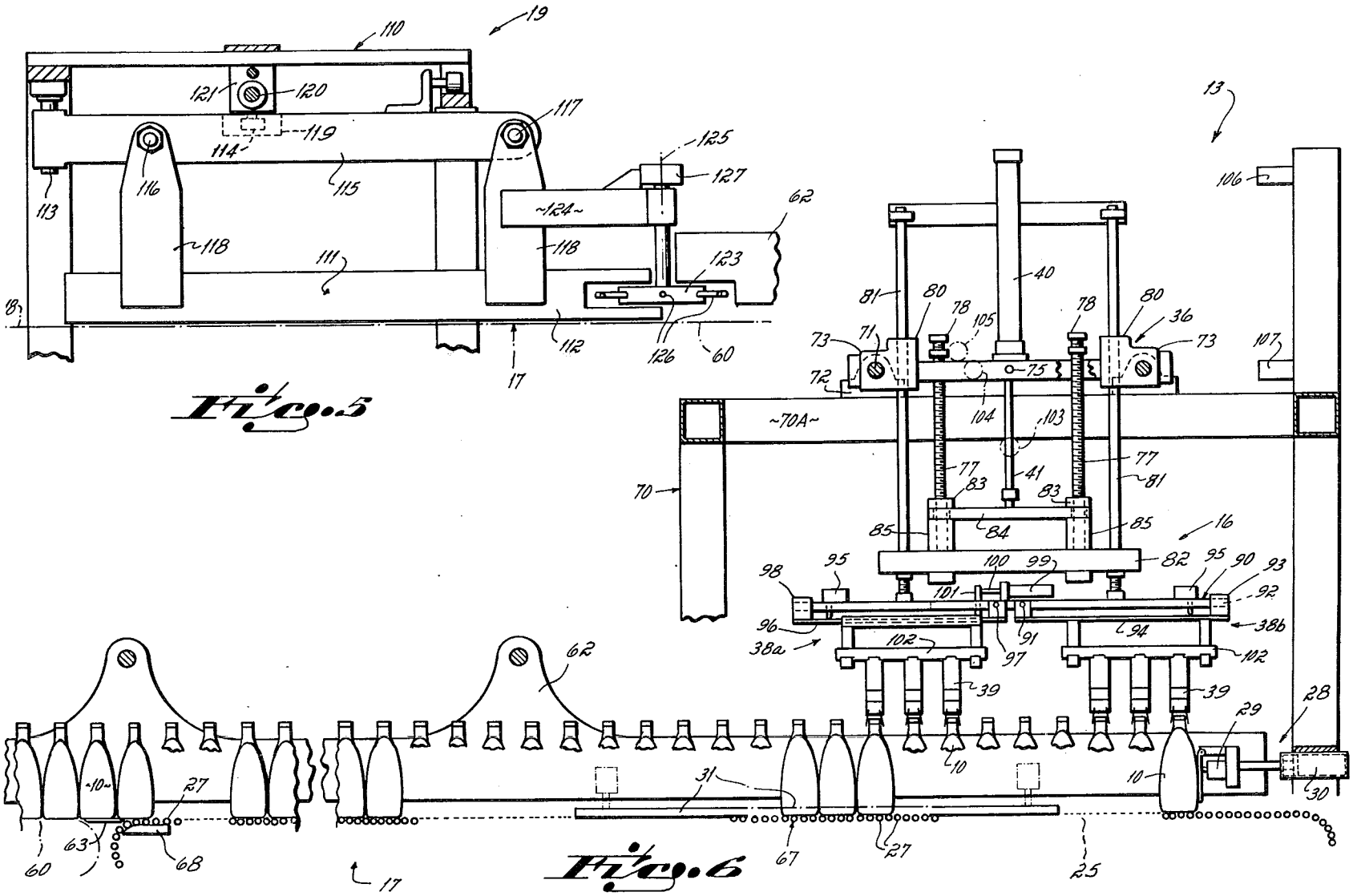
FIG. 5 is a side elevational view of the row former of FIG. 2.
FIG. 6 is a diagrammatic top plan view partly in section of an alternative embodiment of the row former of FIG. 2.
Figure 7:
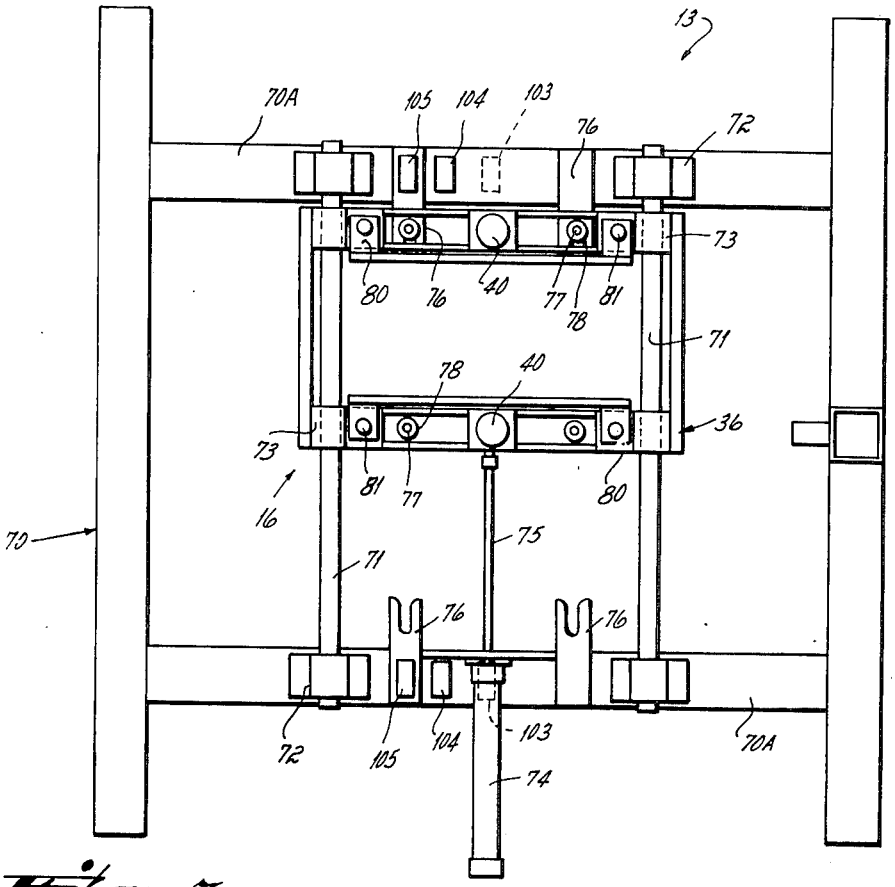
Figure 8:
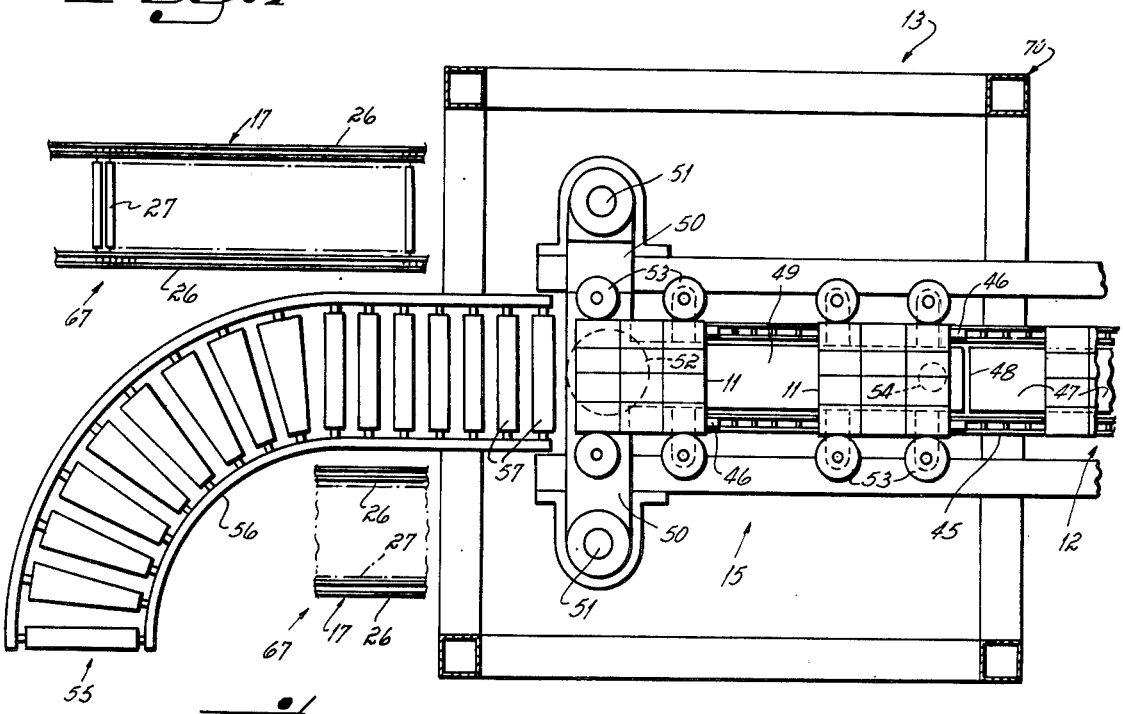

The apparatus of the present invention has as its primary objective to pack bottles 10 into cases 11. The cases are fed single file in spaced apart relation on a case conveyor 12 toward a loading or packing station 13 where two cases are stopped in position to receive, simultaneously, a pattern of bottles. The case conveyor carries the cases through a flap opener 14, ahead of the packing station, which opens up the flaps of the case and exposes the pattern of cells for receipt of the bottles. In the illustrated form of the invention, each case is adapted to hold twelve oval-shaped bottles, the bottles being arranged in a pattern of three rows, each row having four bottles. At the packing station 13 is a case elevator 15 which is adapted to raise the two cases 11 upwardly a few inches to a position in which the cases are to receive the bottles from a transfer mechanism 16. The raising of the cases is desirable in order to shorten the downward stroke of the transfer mechanism during which the bottles are deposited into the cases.

As illustrated in FIGS. 1, 3 and 4, the bottles 10 are conveyed on two conveyors 17 which move in the opposite direction from and parallel to the case conveyor, but it should be understood that the two conveyors could run in the same direction. The bottles are fed to each of the bottle conveyors from a pair of identical single file conveyors 18, each having a row former 19. The row former 19 shifts the bottles into four lanes 20, 21, 22 and 23. The bottles thus proceed to the loading station in the four lanes 20–23. Each bottle conveyor 17 has a downstream section 25 which consists of two endless chains supporting a plurality of transverse rollers rotatably mounted on the chains. At the loading station overlying the conveyor section 25 are stops 28, one stop being placed in each lane. The downstream section 25 of the bottle conveyor also has an elongated brake 31 which is engageable with the upper surfaces of the rollers 27 in order to brake movement of the bottles into the loading station during a transfer operation.

When a sufficient number of bottles have been marshalled in the loading section 13, the bottles are transferred by the transfer mechanism 16 from the bottle conveyor to the cases supported on the case elevator 15. The transfer mechanism includes a horizontally movable carriage 36 which supports two sets of lifting heads 37 and 38 (FIG. 3). Each set 37 or 38 may have one or more lifting heads. In the illustrated form of the invention, two lifting heads 37(*a*) and 37(*b*) are shown in set 37 and two lifting heads 38(*a*) and 38(*b*) are shown in set 38. Each lifting head carries a pattern of twelve bottle grippers 39 corresponding to the pattern of cells in the cases 11. The grippers may be of any suitable type, preferably pneumatically operated, the particular type of gripper being dependent upon the style of the bottle to be transferred, see, for example, U.S. Pat. Nos. 2,873,996 and 3,108,835.

Each set of lifting heads is adapted to be raised and lowered independently of the other set by pistons and cylinders 40, each having a movable piston rod 41 connected to the respective set of heads.

In the operation of the invention, cases 11 are fed to the case elevator 15. When two cases, corresponding to one set of lifting heads, have arrived at the elevator, the elevator raises the cases to the broken line position illustrated in FIGS. 3 and 4.

Simultaneously, the bottles are continuously fed toward the loading station 13. First the bottles are a single file until they pass through the row former 19 which distributes the bottles into the four lanes 20-23 in equal numbers. The bottles continue to be conveyed toward the loading station until they engage the stops 28. When a sufficient number of bottles to make up patterns for loading the two cases has been brought into the loading station, a first transfer operation begins. The first set of lifting heads, for example, 38 in FIG. 3, is lowered onto the bottles and the grippers grasp the necks of the individual bottles.

The piston rod 41 is then retracted, lifting the bottles upwardly away from the conveyor. Substantially simultaneously with the raising of the lifting head is the application of the brake 31 to the rollers. The effect of the application of the brake is to permit the rollers to continue to move but to cause them to rotate in such a direction that their upper surfaces which engage the bottles are effectively moving in the opposite direction from the movement of the conveyor chains so that the bottles do not advance during the removal of the bottles by the lifting heads.

When the bottles are raised a sufficient height, the carriage 36 moves transversely to carry the lifting heads to a position overlying the open cases 11. When in the proper transverse orientation, the piston rod 41 is extended to lower the bottles gently into the cases. As can be seen from FIG. 4, the transverse movement of the carriage 36 to align the lifting heads 38 with the cases also carries the lifting heads 37 to a position aligned with the bottles on the opposite bottle conveyor. As soon as a pattern of bottles is detected under the lifting heads 37, the lifting heads are lowered to engage the bottles and to grasp them and the brake 31 associated with that conveyor is applied. In the meantime, the lifting head 38, having deposited its bottles, is raised and the lifting heads 37 are raised to lift the bottles away from the conveyor. The carriage 36 then moves in the opposite direction to return to the position of FIG. 3. The lifting heads 37 are then aligned in position to deposit the bottles carried by the lifting heads into a new set of cases which has arrived from the case conveyor.

It can be seen that through the tandem operation of two sets of lifting heads, the supply of cases on a single case conveyor can be filled with bottles being marshalled on the two bottle conveyors with the movement of the bottles being approximately one-half the speed that would be required if only one set of lifting heads were employed, as is common practice.

Row Former

Two embodiments of the row former 19 are illustrated in FIGS. 2 and 9, respectively. In FIG. 2, the row former has a frame 110 which supports a swinging guide 111 formed by two longitudinally extending bars 112. The guide 111 is pivoted about a pin 113 at its upstream end, the pin 113 being mounted in the frame 110 at the transverse center of the upstream conveyor section 60 where the guide receives single file bottles. The guide 111 includes a longitudinally extending bar 115 which supports an upstream screw 116 and a downstream screw 117 whose threads on each side of the bar 115 are of opposite hand. The screws are threaded into brackets 118 which are in turn fixed to the bars 112, thus providing the support for the bars 112. The support is adjustable in that rotating the screws 116, 117 will cause the spreading or contracting of the spacing between the bars 112 to permit the bars to accommodate bottles of varying sizes. A control screw 120 is transversely and rotatably mounted in the frame 110. The screw is threaded into a block 121 which is both rotatably and slidably mounted on the frame 110. A roller 114 depends from the block 121 and is engageable with a slot 119 in the bar 115. It can be seen that the rotation of the screw 120 will cause the block 121 to move transversely with respect to the conveyor section 60 and, hence, through the roller 114 swing the bar 115 and the guide 111 which it carries about the pivot pin 113. The screw is connected to a stepping or pulse motor 122 which is in turn connected to a control circuit adapted to pulse the motor with a preselected number of pulses to rotate the screw through a predetermined number of revolutions so as to precisely position the free end of the guide 111 adjacent any respective lane 20–23.

A control wheel 123 is mounted on a bracket 124 fixed to one of the guide bar brackets 118 and adapted to rotate about a vertical axis 125. The wheel has pins or lugs 126 spaced uniformly about its periphery and projectable into the space between the guide bars 112. The wheel 123 is normally freely rotatable but has a brake 127 adapted to stop the rotation of the wheel with any selected pin 126 projecting into the path of the bottles as illustrated.

An electric eye 128 is mounted on supporting bracket 124 and reads indicia on the wheel to detect and count the passing bottles. Programmable counters and control circuitry are associated with the electric eye to count the bottles passing by the wheel 123, and after a preselected number of bottles have passed, to brake the wheel, thereby blocking further passage of bottles. When the bottles are braked, the operation of the stepping motor 122 is initiated to swing the guide 111 to the next adjacent lane. After the guide reaches the next adjacent lane, the stepping motor is deenergized and the brake on the wheel 123 released so that the conveyor section 60 can continue to drive bottles through the lane with which the guide is aligned. An exemplary form of the operation could be to guide six bottles to lane 20, shift to lane 21, guide three bottles into lane 21, shift to lane 22, guide three bottles into lane 22, shift to lane 23, guide six bottles into lane 23, shift to lane 22, guide three bottles into lane 22, shift to lane 21, guide three bottles into lane 21, shift to lane 20, guide six bottles into lane 20, etc.

The embodiment of FIG. 9 is substantially identical to that of FIG. 2 except for the mechanism by which the guide is swung about its pivot axis 113. In FIG. 9, the guide 111 carries a double-acting pneumatic cylinder 130 located at a distance *d* from its pivot axis 113. A piston rod 131 is connected to the frame 110 so that introduction of fluid pressure into either end of the cylinder will cause the guide to swing between the middle two lanes, that is, lanes 21 and 22. Two opposed cylinders 132, 133 of diameter equal to the diameter of the cylinder 130 are mounted on the frame. Each has a projecting piston rod 134 engageable by the bar 136 projecting up from one of the guides 112. The piston rods 134 are spaced from the pivot axis 113 by a distance *2d*. Fluid under the same pressure as that applied to cylinder 130 is applied to cylinders 132 and 133. The operation of the control system of FIG. 9 is as follows:

Assume that the guides are aligned with lane 21, as illustrated, and movement is to be made to lane 20. Fluid pressure is applied to the cylinder 130 to urge the guide to swing toward lane 20. At the same time fluid pressure is relieved in cylinder 132 to permit the guide to move to lane 20. To shift back to lane 21, fluid pressure is applied to cylinder 132. It is resisted by the fluid pressure in cylinder 130. However, the cylinder 132 is operated through a lever arm *2d* which is twice that of the lever arm of the resisting cylinder 130 and hence overcomes the resistance of the cylinder 130. The cylinder 130, however, will stop the guide at lane 21 when the rod 134 has reached the extend of its permissible transverse movement. The shift to lane 22 is effected by reversing the flow of fluid to the cylinder 130. Movement beyond lane 22, however, is blocked by the fluid pressure in cylinder 133 which, due to its lever arm, is sufficient to overcome the force of the piston in cylinder 130. The shift to lane 23 is effected by relieving the pressure in cylinder 133. The reverse operation, that is, the shift from lane 23 to lane 22, is simply the reverse of that described in shifting from lane 20 to lane 21 in that fluid pressure applied to cylinder 133 overcomes the fluid pressure in cylinder 130.

I claim:

1. Apparatus for forming a single file of articles into multiple files comprising, a single file conveyor, a multiple file conveyor having multiple lanes downstream of said single file conveyor, an elongated guide overlying said single file conveyor and pivoted at its upstream end for swinging in a horizontal plane, the downstream end of said guide swinging adjacent the upstream end of said multiple file conveyor, means for positioning the downstream end of said guide adjacent any of said multiple lanes, a wheel mounted on said guide for rotation about a vertical axis, said wheel being normally freely rotatable, a plurality of lugs circumferentially spaced about the periphery of said wheel and projecting into the path of articles passing through said guide, means for braking said wheel to block the flow of articles as said guide shifts from one lane to another, said means for positioning the downstream end of said guide comprising, a screw mounted over said guide and extending transversely to said single file conveyor, a block threaded on said screw, a roller depending from said block, a longitudinal slot in said guide receiving said roller, and a stepping motor for rotating said screw in either direction.

2. Apparatus for forming a single file of articles into multiple files comprising, a single file conveyor, a multiple file conveyor having multiple lanes downstream of said single file conveyor, an elongated guide overlying said single file conveyor and pivoted at its upstream end for swinging in a horizontal plane, the downstream end of said guide swinging adjacent the upstream end of said multiple file conveyor, means for positioning the downstream end of said guide adjacent any of said multiple lanes, a wheel mounted on said guide for rotation about a vertical axis, said wheel being normally freely rotatable, a plurality of lugs circumferentially spaced about the periphery of said wheel and projecting into the path of articles passing through said guide, means for braking said wheel to block the flow of articles as said guide shifts from one lane to another, said means for positioning the downstream end of said guide comprising, support structure for said guide, a double-acting cylinder mounted on said guide, a piston within said cylinder having rods engageable with said support structure to swing said guide, the axis of said piston and cylinder being spaced from the pivoted upstream end of said guide by distance *d*, a pair of opposed cylinders mounted on said support structure with their axes spaced downstream of the upstream end by a distance *2d*, said downstream cylinders having pistons with rods engageable with said guide to move said guide transversely.

3. Apparatus according to claim 2 in which all said cylinders have the same cross-sectional area.

4. Apparatus for forming a single file of articles into multiple files comprising, a single file conveyor, a multiple file conveyor having multiple lanes downstream of said single file conveyor, an elongated guide overlying said single file conveyor and pivoted at its upstream end for swinging in a horizontal plane, a screw mounted transversely of said guide, means connecting said screw to said guide, a stepping motor for rotating said screw in either direction for swinging the downstream end of said guide back and forth adjacent the upstream end of said multiple file conveyor, and for positioning the downstream end of said guide adjacent any of said multiple lanes, a wheel mounted on said guide for rotation about a vertical axis, said wheel being normally freely rotatable, a plurality of lugs circumferentially spaced about the periphery of said wheel and projecting into the path of articles passing through said guide, said articles rotating said wheel as they pass it, means on said wheel for counting the articles passing it, means for braking said wheel in any preselected angular position after a predetermined count of articles to block the flow of articles as said guide shifts from one lane to another, and means for passing bottles to said multiple lane conveyor on each back and forth excursion of said guide, said counting and braking means effecting deposit of twice as many articles in the outside lanes as in the inside lanes of said multiple file conveyor.

5. Apparatus according to claim 4 in which said counting means comprises, an electric eye mounted on said guide and operative to detect indicia corresponding to each said lug projecting from said wheel.

* * * * *